US007839096B2

(12) United States Patent
Kim et al.

(10) Patent No.: US 7,839,096 B2
(45) Date of Patent: Nov. 23, 2010

(54) METHOD OF DRIVING A LAMP, LAMP DRIVING APPARATUS, AND LIQUID CRYSTAL DISPLAY DEVICE HAVING THE SAME

(75) Inventors: Min-Gyu Kim, Seoul (KR); Hyeon-Yong Jang, Osan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 942 days.

(21) Appl. No.: 11/669,473

(22) Filed: Jan. 31, 2007

(65) Prior Publication Data

US 2007/0182701 A1 Aug. 9, 2007

(30) Foreign Application Priority Data

Feb. 6, 2006 (KR) ..... 10-2006-0011052

(51) Int. Cl.
*H05B 37/00* (2006.01)

(52) U.S. Cl. ..... 315/291; 315/169.3; 315/224; 315/307; 345/102

(58) Field of Classification Search ..... 315/169.1, 315/169.2, 169.3, 224, 291, 307; 345/102, 345/87, 76, 77

See application file for complete search history.

(56) References Cited

U.S. PATENT DOCUMENTS 6,791,527 B2 * 9/2004 Yoshinaga et al. ..... 345/102
2006/0007109 A1 * 1/2006 Noritake ..... 345/102

* cited by examiner

*Primary Examiner*—David Hung Vu
(74) *Attorney, Agent, or Firm*—F. Chau & Associates, LLC

(57) ABSTRACT

A lamp driving apparatus includes a change rate calculating section, a dimming transforming section and a power supplying section. The change rate calculating section calculates a change rate signal from an image signal corresponding to the image. The dimming transforming section outputs a digital dimming signal and an analog dimming signal, in response to a dimming signal provided from an external device and the change rate signal. The power supplying section provides the lamp with power, in response to a vertical synchronizing signal, the analog dimming signal and the digital dimming signal. Thus, although an instantaneous lamp current is increased, life and characteristics of the lamp will not be adversely influenced, and motion blur of a moving image may be removed.

14 Claims, 8 Drawing Sheets

METHOD OF DRIVING A LAMP, LAMP DRIVING APPARATUS, AND LIQUID CRYSTAL DISPLAY DEVICE HAVING THE SAME

CROSS-REFERENCE TO RELATED APPLICATION

This application claims priority from Korean Patent Application No. 2006-11052 filed on Feb. 6, 2006 in the Korean Intellectual Property Office, The contents of which are herein incorporated by reference in their entirety.

BACKGROUND OF THE INVENTION

1. Technical Field

The present disclosure relates to a method of driving a lamp, a lamp driving apparatus for performing the method of driving the lamp, and a liquid crystal display device having the lamp driving apparatus. More particularly, the present disclosure relates to a method of driving a lamp for variably adjusting a driving duty cycle of the lamp and adjusting a supply voltage according to an image change rate, a lamp driving apparatus for performing the method of driving the lamp, and a liquid crystal display device having the lamp driving apparatus.

2. Discussion of the Related Art

Generally, a liquid crystal display ("LCD") device displays an image thereon by adjusting a transmission of light through the liquid crystal, according to image information that is provided from an external device. In order to display the image, an LCD panel of the LCD device includes liquid crystal cells arranged in a matrix and a switching element, such as a thin-film transistor ("TFT"), for switching the image information that corresponds to each of the liquid crystal cells.

A driving apparatus of the LCD panel controls the switching elements to provide each of the liquid crystal cells with the image information. Further, the driving apparatus of the LCD panel suppresses deterioration of the image induced by blinking, afterimages, etc. Additionally, the driving apparatus of the LCD panel controls the LCD panel so that the image information includes a positive polarity or a negative polarity for a predetermined voltage level, so as to decrease a driving voltage of the LCD panel.

As display technology becomes more developed, technology for displaying moving images is increasingly more in demand, in addition to the technology for displaying still images. The technology for displaying moving images, however, is somewhat difficult to implement in the LCD device, because a response speed of the liquid crystal is slower than a one-frame period, that is, a time period corresponding to one frame, when a new voltage is supplied to the liquid crystal at the following frame after maintaining a voltage, for example, an image signal or a data voltage, charged in the liquid crystal during the one frame period, motion blur is generated.

To remove the motion blur, the LCD device controls an operation of turning a lamp on and off, in response to a display speed of the image and a display phase of the image.

When the lamp is turned off, however, a luminance may be decreased. Therefore, in order to solve the decrease in luminance of the LCD device, a current supplied to the lamp is increased when the lamp is turned on. More specifically, when the lamp is turned on and off, in response to the display speed and display phase of the image, the motion blur is removed. Accordingly, the image is cleanly displayed on the LCD device, but the luminance may be decreased when the lamp is turned off.

SUMMARY OF THE INVENTION

Exemplary embodiments of the present invention provide a method of driving a lamp capable of removing motion blur of a moving image by adjusting a driving duty cycle of the lamp and adjusting a supply voltage, which will not adversely influence the life and characteristics of the lamp source, although an instantaneous lamp current is increased.

Exemplary embodiments of the present invention also provide a liquid crystal apparatus for performing the method of driving the lamp.

Exemplary embodiments of the present invention also provide a liquid crystal display ("LCD") device having the lamp driving apparatus.

In an exemplary embodiment of the present invention, an image change rate signal that is provided from an external device is calculated, and the calculated change rate is compared with a reference change rate. The lamp is driven by using a digital dimming signal and an analog dimming signal, when the calculated change rate is smaller than or equal to the reference change rate, the digital dimming signal has a normal "on" interval, and the analog dimming signal has a normal level. The lamp is driven by using a digital dimming signal and an analog dimming signal, when the calculated change rate is greater than the reference change rate, the digital dimming signal has a short "on" interval that is shorter than the normal "on" interval, and the analog dimming signal has a high level that is higher than the normal level.

The digital dimming signal controls an emission duty cycle of the lamp.

In an exemplary embodiment of the present invention, the analog dimming signal controls the power that is provided to the lamp.

In an exemplary embodiment of the present invention, the lamp driving apparatus provides power to the lamp supplying light to a liquid crystal panel, which displays an image using a liquid crystal layer. The lamp driving apparatus includes a change rate calculating section, a dimming transforming section and a power supplying section, and the change rate calculating section calculates a change rate signal from an image signal corresponding to the image. The dimming transforming section outputs a digital dimming signal, which controls an emission duty cycle of the lamp, and an analog dimming signal, which controls the power that is provided to the lamp, in response to a dimming signal provided from an external device and the change rate signal. The power supplying section provides the lamp with power, in response to a vertical synchronizing signal, the analog dimming signal, and the digital dimming signal.

The digital dimming signal may be a pulse-width modulation ("PWM") signal.

In an exemplary embodiment of the present invention, the change rate calculating section may be a Moving Picture Experts Group ("MPEG") decoder.

In an exemplary embodiment of the present invention, the LCD device includes a panel section, a lamp section, an image signal processing section and a lamp driving section. The panel section displays an image using a liquid crystal layer, and the lamp section provides the panel section with light. The image signal processing section provides the panel section with an image signal that is supplied from an external device. The lamp driving section drives the lamp section, in response to a change rate of the image signal.

The lamp driving section decreases an emission duty cycle of a lamp of the lamp section, and increases a current that is supplied to the lamp section during a period when the change rate is relatively high. Further, the lamp driving section may maintain an emission duty cycle of the lamp and a current that is supplied to the lamp section during a period when the change rate is relatively low.

In an exemplary embodiment of the present invention, the light driving section includes a change rate calculating section, a dimming transforming section, and a power supplying section, and the change rate calculating section calculates a change rate signal from the image signal. The dimming transforming section outputs an analog dimming signal and a PWM dimming signal, in response to a dimming signal that is supplied from an external device and the change rate signal. The power supplying section provides the lamp with power, in response to the vertical synchronizing signal corresponding to the image signal and the analog and PWM dimming signals.

The dimming transforming section includes a storing section, a comparator, an adder, a subtracter, and a PWM transforming section, and the storing section stores an analog dimming reference value. The comparator compares the change rate signal and the reference change rate signal that is supplied from an external device to output a comparative-determining signal. The adder adds the comparative-determining signal and the analog dimming reference value to output the analog dimming signal, and the subtracter subtracts the comparative-determining signal from a dimming signal that is supplied from an external device to output the subtracted dimming signal. The PWM transforming section transforms the subtracted dimming signal into a PWM dimming signal and outputs the PWM dimming signal.

The dimming transforming section provides the power supplying section with a PWM dimming signal having a normal "on" interval and an analog dimming signal having a normal level, when the calculated change rate is smaller than or equal to the reference change rate. Alternatively, the dimming transforming section provides the power supplying section with a PWM dimming signal having a short "on" interval that is relatively shorter than the normal "on" interval and an analog dimming signal having a high level that is relatively higher than the normal level, when the calculated change rate is greater than the reference change rate.

The image signal processing section includes a timing control section, a data driver and a gate driver, and the timing control section receives a first signal and a first synchronizing signal, to output a second image signal, a second synchronizing signal, and a third synchronizing signal. The data driver outputs a data signal to the panel section, in response to the second image signal and the second synchronizing signal. The gate driver outputs a gate signal to the panel section, in response to the third synchronizing signal. The timing control section comprises a change rate calculating section calculating a change rate signal from the first image signal.

According to exemplary embodiments of the present invention, the method and the apparatus for driving a lamp, and an LCD device having the apparatus, a driving duty cycle of a lamp and supplied power are variably controlled, in response to a change rate of the images. Therefore, although an instantaneous current is increased, life and characteristics of the lamp will not be adversely influenced, and motion blur of a moving image can be removed.

BRIEF DESCRIPTION OF THE DRAWINGS

Exemplary embodiments of the present invention will be understood in more detail from the following descriptions taken in conjunction with the accompanying drawings wherein.

DESCRIPTION OF EXEMPLARY EMBODIMENTS

Figure 1:
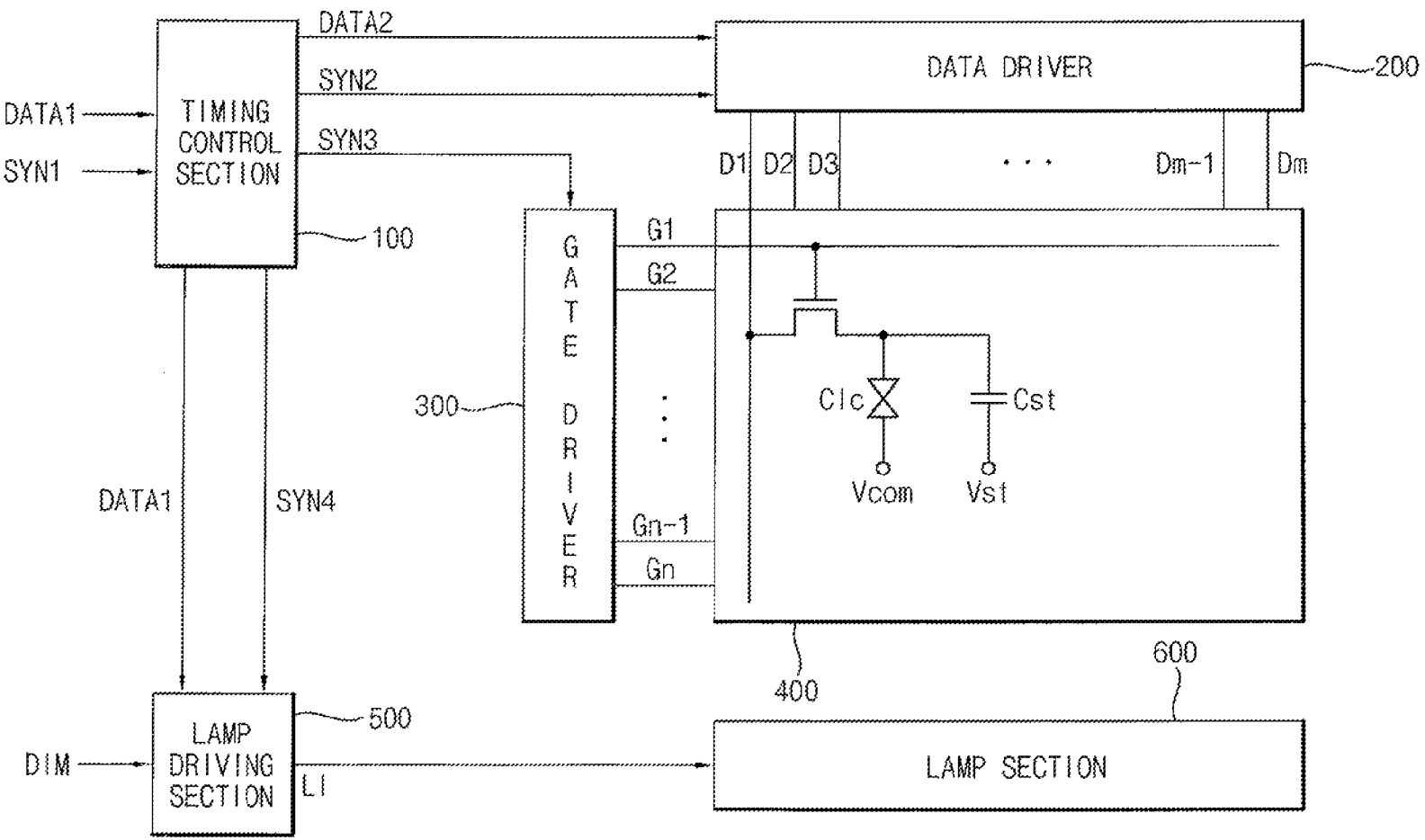
FIG. 1 is a block diagram illustrating a liquid crystal display ("LCD") device according to an exemplary embodiment of the present invention.
Figure 2:
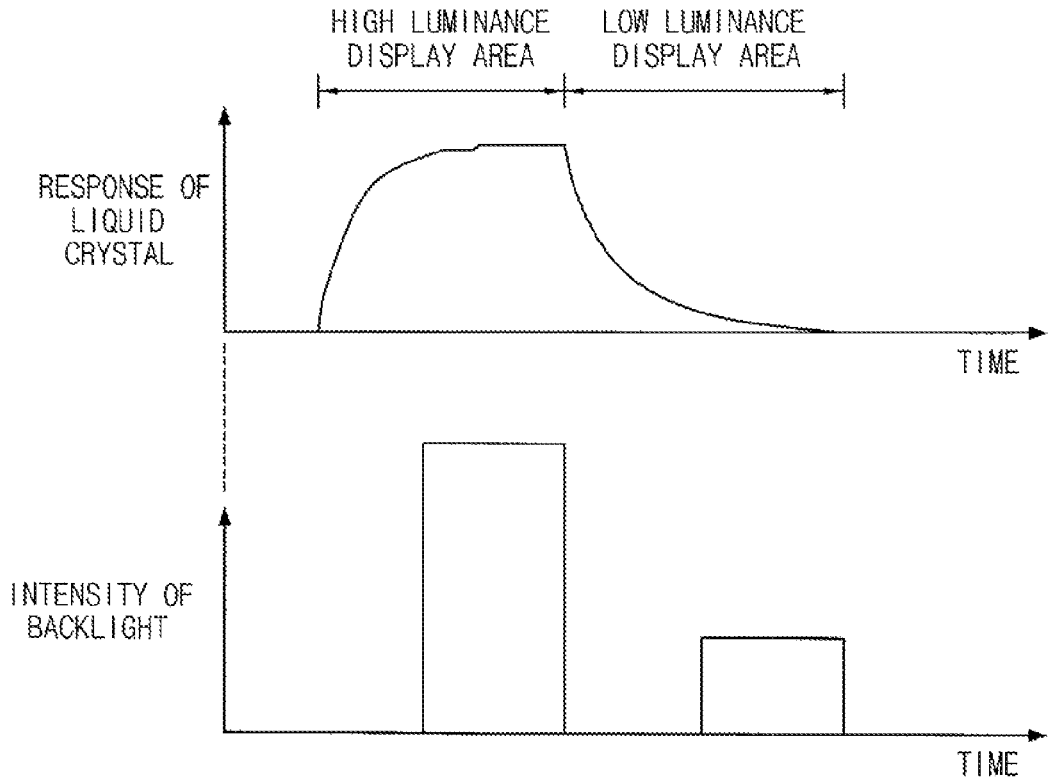
FIG. 2 illustrates an intensity of a backlight according to a displayed image.

FIG. 1 is a block diagram illustrating a liquid crystal display ("LCD") device according to an exemplary embodiment of the present invention. FIG. 2 illustrates graphs showing an intensity of a backlight according to a displayed image.

Referring to FIG. 1, an LCD device according to an exemplary embodiment of the present invention includes a timing control section 100, a data driver 200, a gate driver 300, an LCD panel 400, a lamp driving section 500 and a lamp section 600. The timing control section 100, a data driver 200 and a gate driver 300 may define an image signal processing section that provides the LCD panel 400 with an image signal for display that is applied from an external device.

The timing control section 100 receives a first image signal DATA1 and a first synchronizing signal SYN1, and outputs a second image signal DATA2, a second synchronizing signal SYN2 and a third synchronizing signal SYN3. The first synchronizing signal SYN1 includes a vertical synchronizing signal, a horizontal synchronizing signal, a main clock signal, and a data enable signal. The vertical synchronizing signal represents a time required for displaying one frame. The horizontal synchronizing signal represents a time required for displaying one line of the frame. Thus, the horizontal synchronizing signal includes pulses corresponding to the number of pixels included in one line. The data enable signal represents a time required for supplying the pixel with data. The second synchronizing signal SYN2 includes a load signal, a horizontal start signal and a polarity control signal for outputting the second image signal DATA2. The third synchronizing signal SYN3 includes a gate clock signal and a vertical start signal.

The data driver 200 outputs a data signal to the LCD panel 400 based on the second image signal DATA2 and the second synchronizing signal SYN2. The timing control section 100 and the data driver 200 are separately described in logical terms for ease of understanding, whether or not they are separate physical hardware elements.

The gate driver 300 outputs a gate signal to the LCD panel 400 based on the third synchronizing signal SYN3.

The LCD panel 400 displays images using a liquid crystal layer disposed between a first substrate and a second substrate. In detail, the LCD panel 400 includes a plurality of data lines (D1, D2, . . . , Dm−1, Dm), a plurality of gate lines (G1, G2, . . . , Gn−1, Gn), and a thin-film transistor that are formed in an area defined by the gate lines (G1, G2, . . . , Gn−1, Gn) and the data lines (D1, D2, . . . , Dm−1, Dm), respectively.

The data lines (D1, D2, . . . , Dm−1, Dm) are extended along a first direction. The data lines (D1, D2, . . . , Dm−1, Dm) transfer a plurality of data signals to the thin-film transistor. The gate lines (G1, G2, . . . , Gn−1, Gn) are extended along a second direction that is substantially perpendicular to the first direction. The gate lines (G1, G2, . . . , Gn−1, Gn) sequentially transfer a plurality of gate signals to the thin-film transistor, and the gate signals have a voltage level for turning on/off the thin-film transistor.

The thin-film transistor includes a source electrode, a gate electrode and a drain electrode. The source electrode is electrically connected to one of the data lines (D1, D2, . . . , Dm−1, Dm), so that the source electrode receives the data signal. The gate electrode is electrically connected to one of the gate lines (G1, G2, . . . , Gn−1, Gn), so that the gate electrode receives the gate signal. The drain electrode is electrically connected to a liquid crystal capacitor Clc and a storage capacitor Cst.

The lamp driving section 500 maintains relatively constant an emission duty cycle of the lamp section 600 and a current that is supplied to the lamp section 600, during a period when the change rate of the first image signal DATA1 is relatively low.

Alternatively, the lamp driving section 500 decreases an emission duty cycle of the lamp section 600 and increases a current that is supplied to the lamp section 600, during a period when the change rate of the first image signal DATA1 is relatively high.

The lamp section 600 includes, for example, at least one lamp, and provides the LCD panel 400 with light based on a driving current that is supplied from the lamp driving section 500. Alternatively, the lamp section 600 includes at least one red light-emitting diode ("LED") emitting a red light, at least one green LED emitting a light, and at least one blue LED emitting a blue light.

Referring to FIGS. 1 and 2, the lamp section 600 performs a blinking operation based on a displayed image.

When a luminance of the display image is relatively high, the lamp section 600 provides the LCD panel 400 with light of a relatively high luminance, in response to a driving current of a relatively high level.

Alternatively, when a luminance of the display image is relatively low, the lamp section 600 provides the LCD panel 400 with light of a normal luminance, in response to a driving current of a normal level.

As described above, a tube current of a relatively high level is supplied into the lamp only when necessary because a variation of the images that are displayed on an actual display device is low, so that a life of the lamp is substantially extended.

The time during which a moving image moves severely is within a few seconds, and a probability that the image moves severely is low, namely about 1/30. Accordingly, the lamp current having a relatively high level is supplied to the lamp section, which does not adversely influence the life of the lamp.

Figure 3:
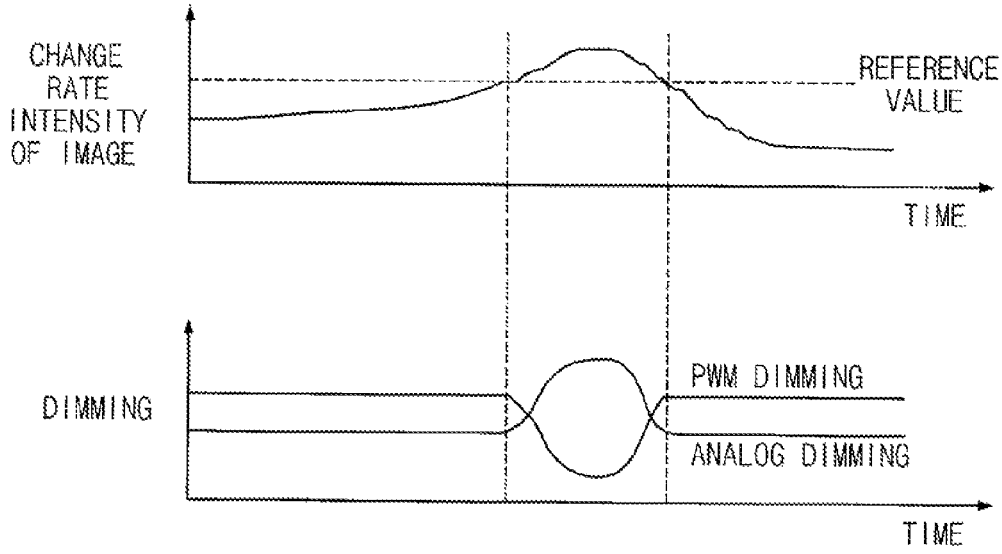
FIG. 3 shows a relationship between a pulse-width modulation ("PWM") dimming and an analog dimming according to an image change rate in accordance with an exemplary embodiment of the present invention.

FIG. 3 is a graph showing a relationship between a pulse-width modulation ("PWM") dimming and an analog dimming according to an image change rate in accordance with an exemplary embodiment of the present invention.

Referring to FIG. 3, when an image change rate intensity is lower than a reference value, the analog dimming signal and the PWM dimming signal have a normal level and a normal duty cycle, respectively. The image change rate intensity is defined by multiplying a moving velocity of the image and a moving size of the image. The displayed image has a relatively low image change rate from frame to frame, or the displayed image is a substantially still image.

When the image change rate intensity is greater than or equal to the reference value, the analog dimming signal has a relatively high level, and the PWM dimming signal has a relatively low duty cycle. The displayed image has a relatively high image change rate from frame to frame, such as a moving image.

Accordingly, the lamp section is blinked by using a PWM dimming signal having a relatively low duty cycle, so that a clear image may be displayed. A blinking interval of the image is larger, so that a luminance of the displayed image is lower, however, the analog dimming signal having a relatively high level is supplied to the lamp section, so that a current that is supplied to the lamp section is raised. Therefore, a reduction of the luminance of the image may be compensated for.

Figure 4:
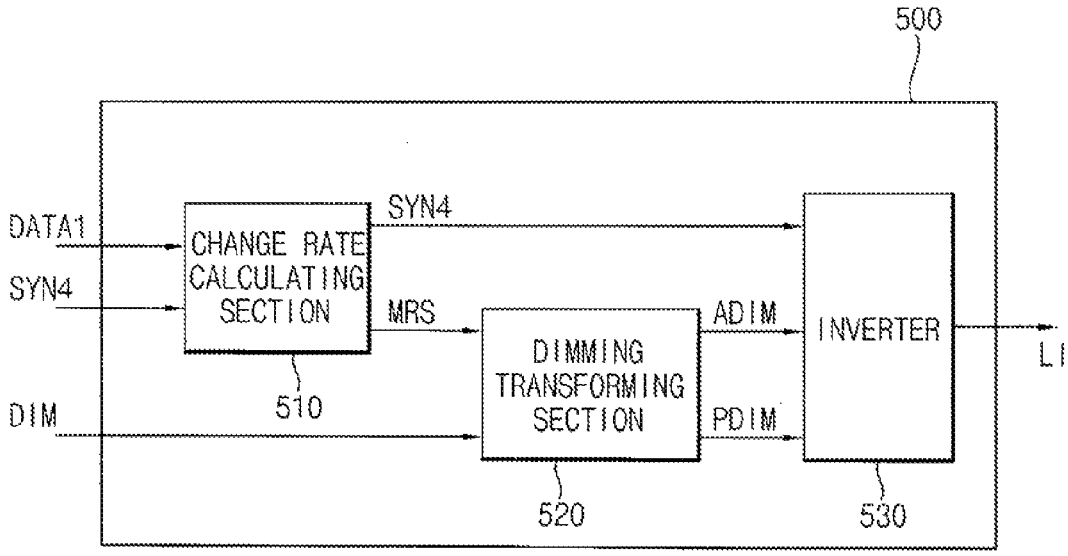
FIG. 4 is a block diagram illustrating the lamp driving section in FIG. 1.

FIG. 4 is a block diagram illustrating the lamp driving section 500 shown in FIG. 1.

Referring to FIG. 4, the lamp driving section 500 according to an exemplary embodiment of the present invention includes a change rate calculating section 510, a dimming transforming section 520 and an inverter 530.

The change rate calculating section 510 calculates a change rate signal MRS from the first image signal DATA1 and the fourth synchronizing signal SYN4 that are provided from the timing control section 100. The change rate calculating section 510 provides the dimming transforming section 520 with the change rate signal MRS, and provides the inverter 530 with the fourth synchronizing signal SYN4. The change rate calculating section 510 includes an MPEG decoder. The fourth synchronizing signal SYN4 includes a vertical synchronizing signal.

The dimming transforming section 520 outputs an analog dimming signal ADIM and a digital dimming signal PDIM based on a dimming signal DIM that is provided from an external device and the change rate signal MRS. The analog dimming signal ADIM controls a variation of a tube current of a lamp in order to adjust a luminance of the lamp. The PWM dimming signal controls a time interval variation corresponding to the tube current of the lamp in order to adjust a luminance of the lamp.

The inverter 530 provides the lamp section 600 with power (or a driving current) LI based on a vertical synchronizing signal corresponding to the first image signal DATA1, the analog dimming signal ADIM and the digital dimming signal PDIM.

The inverter 530 provides the lamp section 600 with a driving current having a normal level and a normal duty cycle, in response to receiving the analog dimming signal ADIM having a normal level and the digital dimming signal PDIM having a normal duty cycle.

Alternatively, the inverter 530 provides the lamp section 600 with a driving current having a relatively high level and a relatively low duty cycle, in response to receiving an analog dimming signal ADIM having a relatively high level, and a digital dimming signal PDIM having a relatively low duty cycle.

Figure 5:
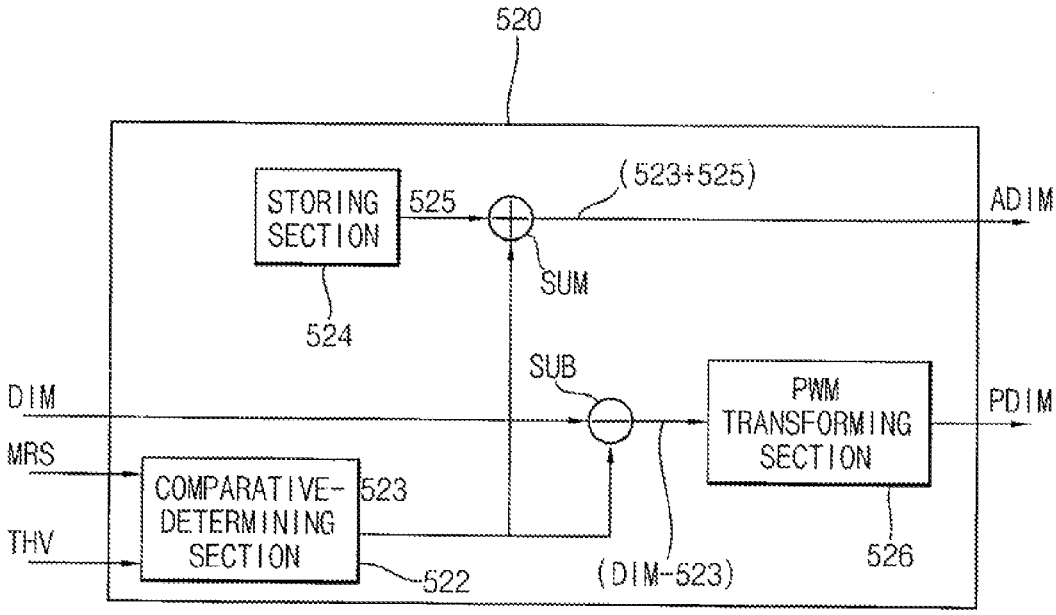
FIG. 5 is a block diagram illustrating the dimming transforming section in FIG. 4.

FIG. 5 is a block diagram illustrating the dimming transforming section 520 shown in FIG. 4.

Referring to FIGS. 4 and 5, the dimming transforming section 520 includes a comparative-determining section 522, a storing section 524, an adder SUM, a subtracter SUB, and a PWM transforming section 526.

The comparative-determining section 522 compares the change rate signal MRS and the reference change rate signal THV that is supplied from an external device, to output a comparative-determining signal to the adder SUM.

The storing section 524 stores an analog dimming reference value 525. For example, each of the reference change rate signal THV and the analog dimming reference value 525 may be set by the manufacturer of the LCD device. Alternatively, each of the reference change rate signal THV and the analog dimming reference value 525 may be set by a user of the LCD device through an additional button, an on-screen display method, or some other method.

The adder SUM adds the comparative-determining signal 523 and the analog dimming reference value 525, and outputs the analog dimming signal ADIM to the inverter 530.

The subtracter SUB subtracts the comparative-determining signal from a dimming signal DIM that is provided from an external device, and outputs the subtracted dimming signal DIM-523 to the PWM transforming section 526.

The PWM transforming section 526 transforms the subtracted dimming signal DIM-523 into a PWM dimming signal PDIM, and outputs the PWM dimming signal PDIM to the inverter 530.

Figure 6:
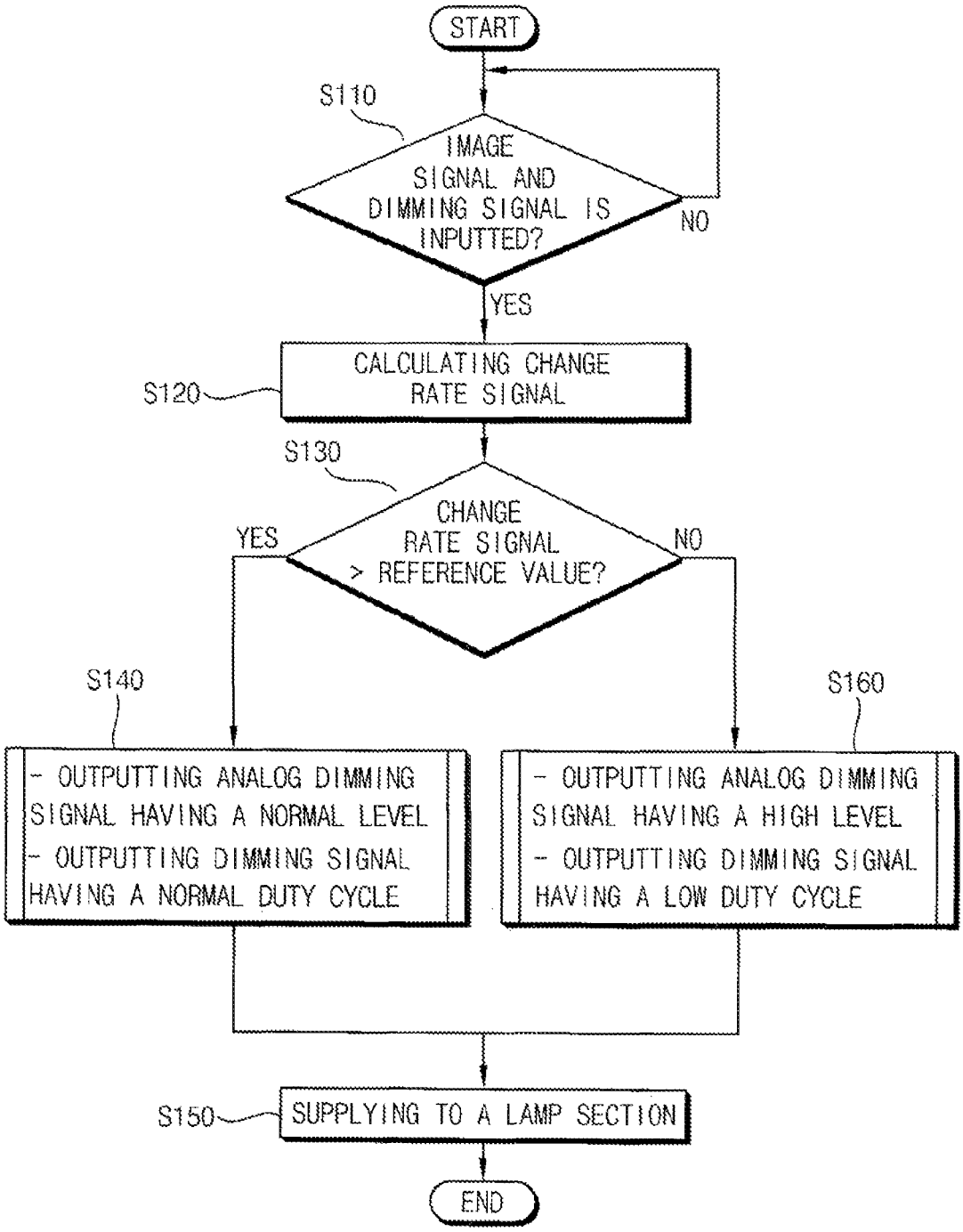
FIG. 6 is a flow chart illustrating a lamp driving method according to an exemplary embodiment of the present invention.

FIG. 6 is a flow chart illustrating a lamp driving method according to an exemplary embodiment of the present invention.

Referring to FIG. 6, it is first determined whether the first image signal and the dimming signal are inputted from an external device (step S110).

When the first image signal and the dimming signal are not inputted, step S110 is repeated. When the first image signal and the dimming signal are inputted, the change rate signal is calculated from the first image signal (step S120).

Next, whether the change rate signal is greater than a reference value (step S130) is determined.

When the reference value is greater than the change rate signal in step S130, an analog dimming signal having a normal level, and a PWM dimming signal having a normal duty cycle, that is, a normal "on" interval, are outputted (step S140).

A driving current is supplied to a lamp section including a lamp or a light-emitting diode ("LED"), in response to a vertical synchronizing signal supplied from an external device, the analog dimming signal and the PWM dimming signal (step S150).

When the reference value is smaller than or equal to the change rate signal in step S130, an analog dimming signal having a high level that is higher than the normal level, and a PWM dimming signal having a relatively low duty cycle, that is, a short "on" interval that is shorter than the normal "on" interval, are outputted (step S160), and step S150 is performed.

Figure 7:
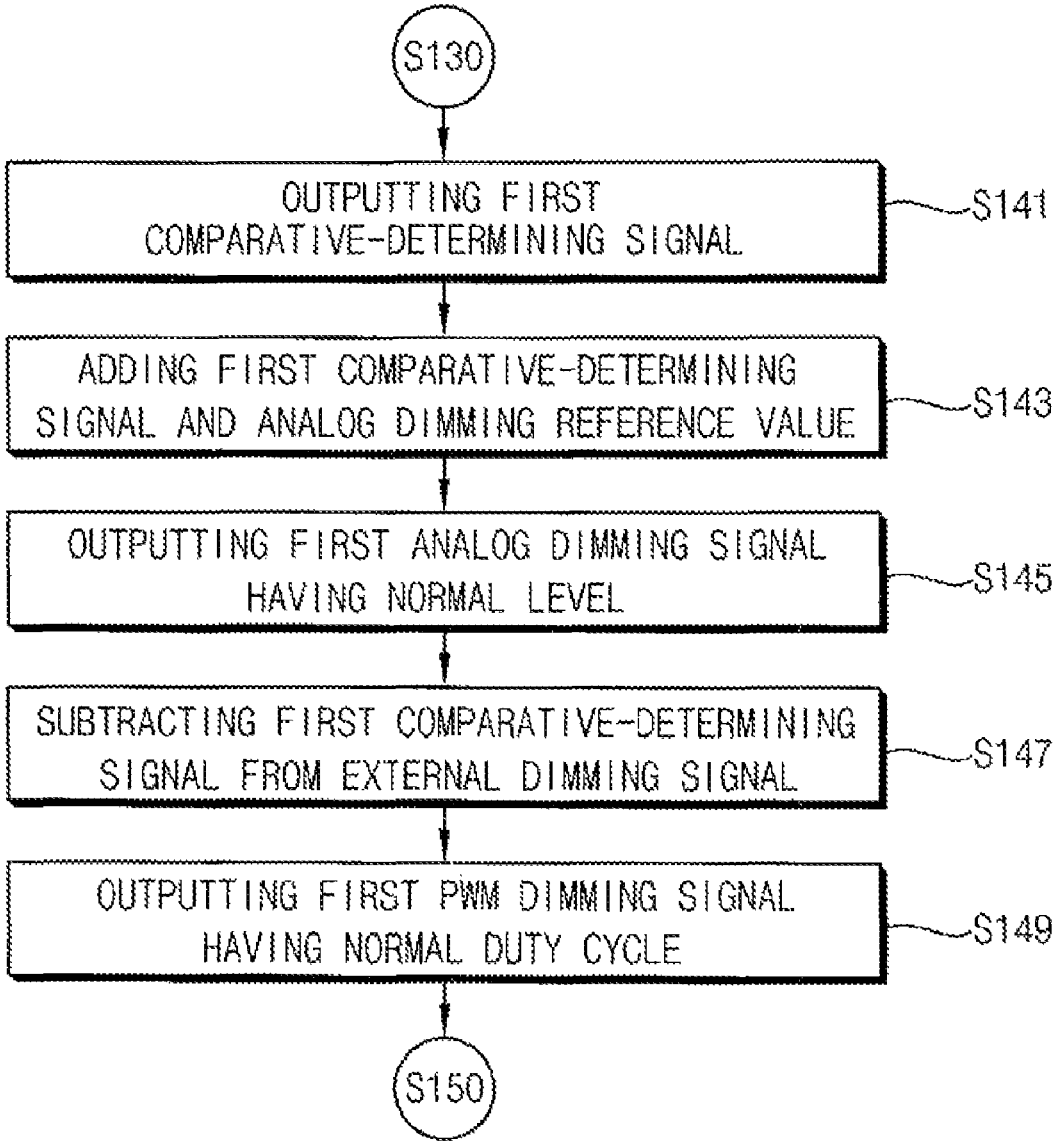
FIG. 7 is a flow chart illustrating step S140 in FIG. 6.

FIG. 7 is a flow chart illustrating step S140 shown in FIG. 6.

Referring to FIGS. 5 to 7, when the change rate signal is greater than the reference value in step S130, a first comparative-determining signal is outputted (step S141). The first comparative-determining signal is substantially zero.

Next, the first comparative-determining signal and the analog dimming reference value are added (step S143), and a first analog dimming signal having a normal level (step S145) is outputted. The first dimming signal is the analog dimming reference value that is stored in the storing section 524 (see FIG. 5), since the first comparative-determining signal is substantially zero.

Next, the first comparative-determining signal is subtracted from an external dimming signal that is supplied from an external device (step S147). In step S147, the subtracted signal is the external dimming signal, since the first comparative-determining signal is substantially zero.

Next, a first PWM dimming signal having a normal "on" interval corresponding to the external dimming signal is outputted (step S149), and step S150 is performed.

As described above, in the exemplary embodiment, step S143 and step S145 may first be sequentially performed, and then step S147 and step S149 may secondly be sequentially performed, however, step S147 and step S149 may first be sequentially performed, and then step S143 and step S145 may secondly be sequentially performed. Alternatively, steps S143, S145, S147 and S149 may be simultaneously performed.

Figure 8:
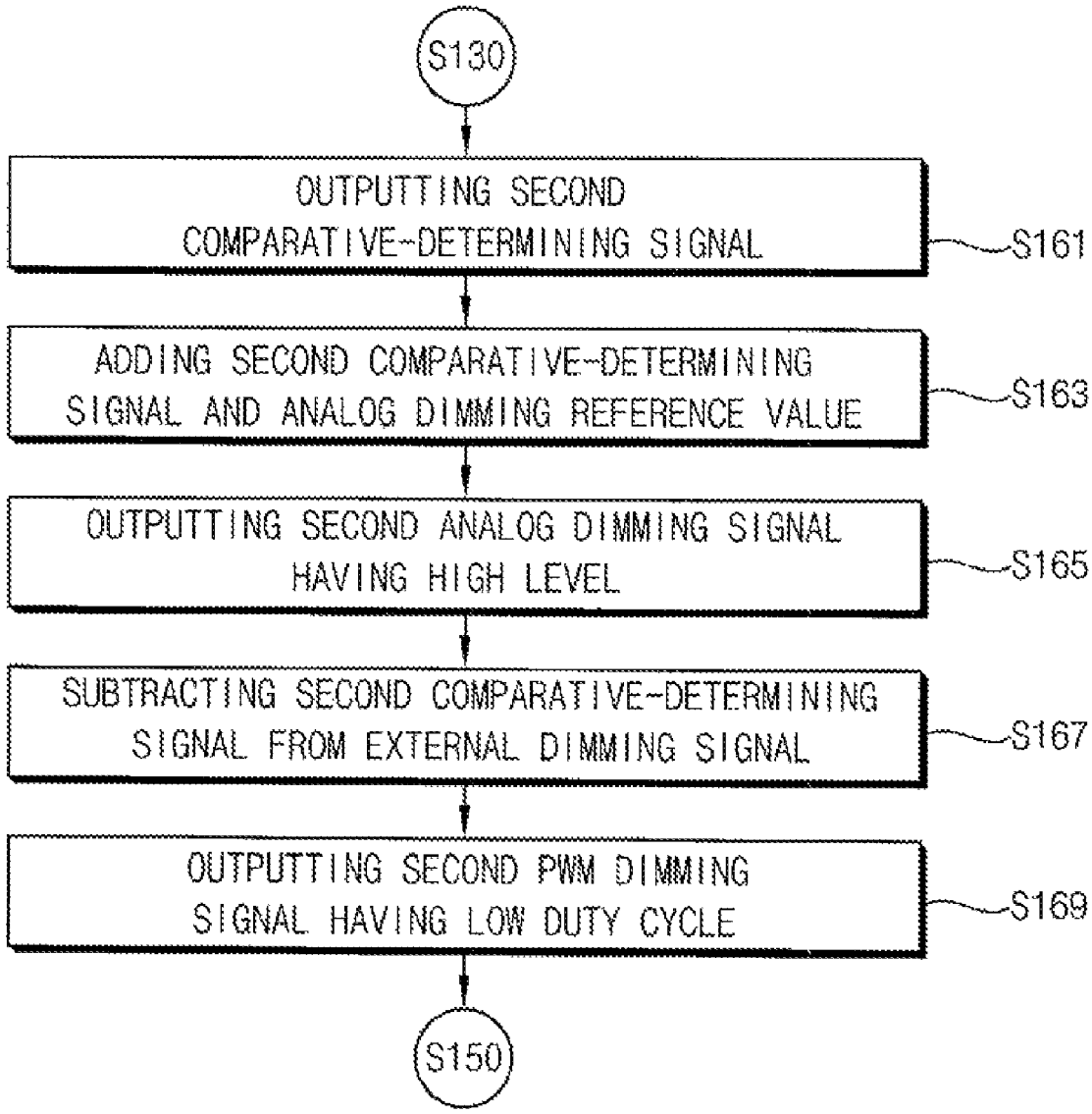
FIG. 8 is a flow chart illustrating step S160 in FIG. 6.

FIG. 8 is a flow chart illustrating step S160 shown in FIG. 6.

Referring to FIGS. 5 to 8, when the change rate signal is smaller than or equal to the reference value in step S130, a second comparative-determining signal is outputted (step S161). The second comparative-determining signal is proportioned to a change rate signal.

Next, the second comparative-determining signal and the stored analog dimming signal are added (step S163), and a second analog dimming signal having a relatively high level is outputted (step S165). The second analog dimming signal is greater than the analog dimming reference value that is stored in the storing section 524 (see FIG. 5) since the second comparative-determining signal is proportional to the change rate signal.

Next, the second comparative-determining signal is subtracted from an external dimming signal DIM supplied from an external device (step S167).

Next, the subtracted signal that is subtracted in step S167 is transformed into a second PWM dimming signal (step S169), and step S150 is performed. The second PWM dimming signal has a lower duty cycle than a normal duty cycle. The normal duty cycle may be a duty cycle of the first PWM dimming signal that is outputted corresponding to the external dimming signal. For example, the second PWM dimming signal has a relatively short "on" interval.

As described above, in the exemplary embodiment, step 163 and step S165 may first be sequentially performed, and then step S167 and step S169 may secondly be sequentially performed, however, step S167 and step S169 may first be sequentially performed, and then step S163 and step S165 may secondly be sequentially performed. Alternatively, steps S163, S165, S167 and S169 may be simultaneously performed.

Figure 9:
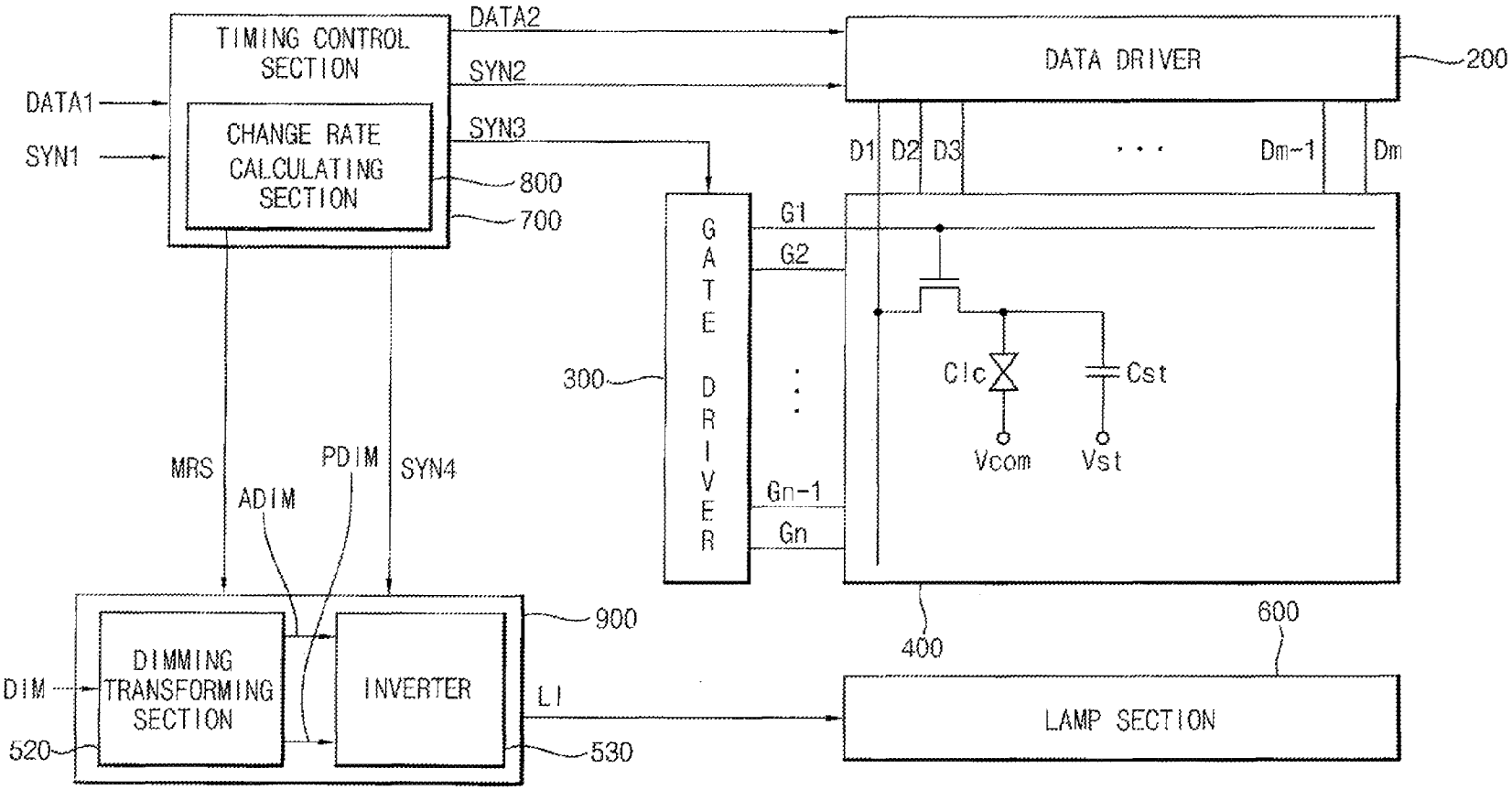
FIG. 9 is a block diagram illustrating an LCD device according to an exemplary embodiment of the present invention.

FIG. 9 is a block diagram illustrating an LCD device according to an exemplary embodiment of the present invention.

Referring to FIG. 9, an LCD device according to an exemplary embodiment of the present invention includes a timing control section 700, a data driver 200, a gate driver 300, an LCD panel 400, a lamp driving section 900, and a lamp section 600. The data driver 200, the gate driver 300, the LCD panel 400 and the lamp section 600 are substantially the same as in FIG. 1. Thus, the same reference numerals will be used to refer to the same or like parts as those described in FIG. 1 and any further explanation concerning the above elements will be omitted. The timing controller 700, the data driver 200 and the gate driver 300 define an image processing section that provides the LCD panel 400 with an image signal that is provided from an external device.

The timing control section 700 includes a change rate calculating section 800. The timing control section 700 receives a first image signal DATA1 and a first synchronizing signal SYN1, and outputs a second image signal DATA2, a second synchronizing signal SYN2 and a third synchronizing signal SYN3.

The lamp driving section 900 includes a dimming transforming section 520 and an inverter 530. The dimming transforming section 520 and the inverter 530 are substantially the same as in FIG. 4 and FIG. 5. Thus, the same reference numerals will be used to refer to the same or like parts as those described in FIG. 4 and FIG. 5 and any further explanation concerning the above elements will be omitted.

During a period when the change rate of the first image signal DATA1 is relatively low, the lamp driving section 900 maintains a normal emission duty cycle of the lamp section 600, and maintains a normal current that is supplied to the lamp section 600.

Alternatively, the lamp driving section 900 relatively decreases an emission duty cycle of the lamp section 600 during a period when the change rate of the first image signal DATA1 is relatively high, and increases a current that is supplied to the lamp section 600.

Figure 10:
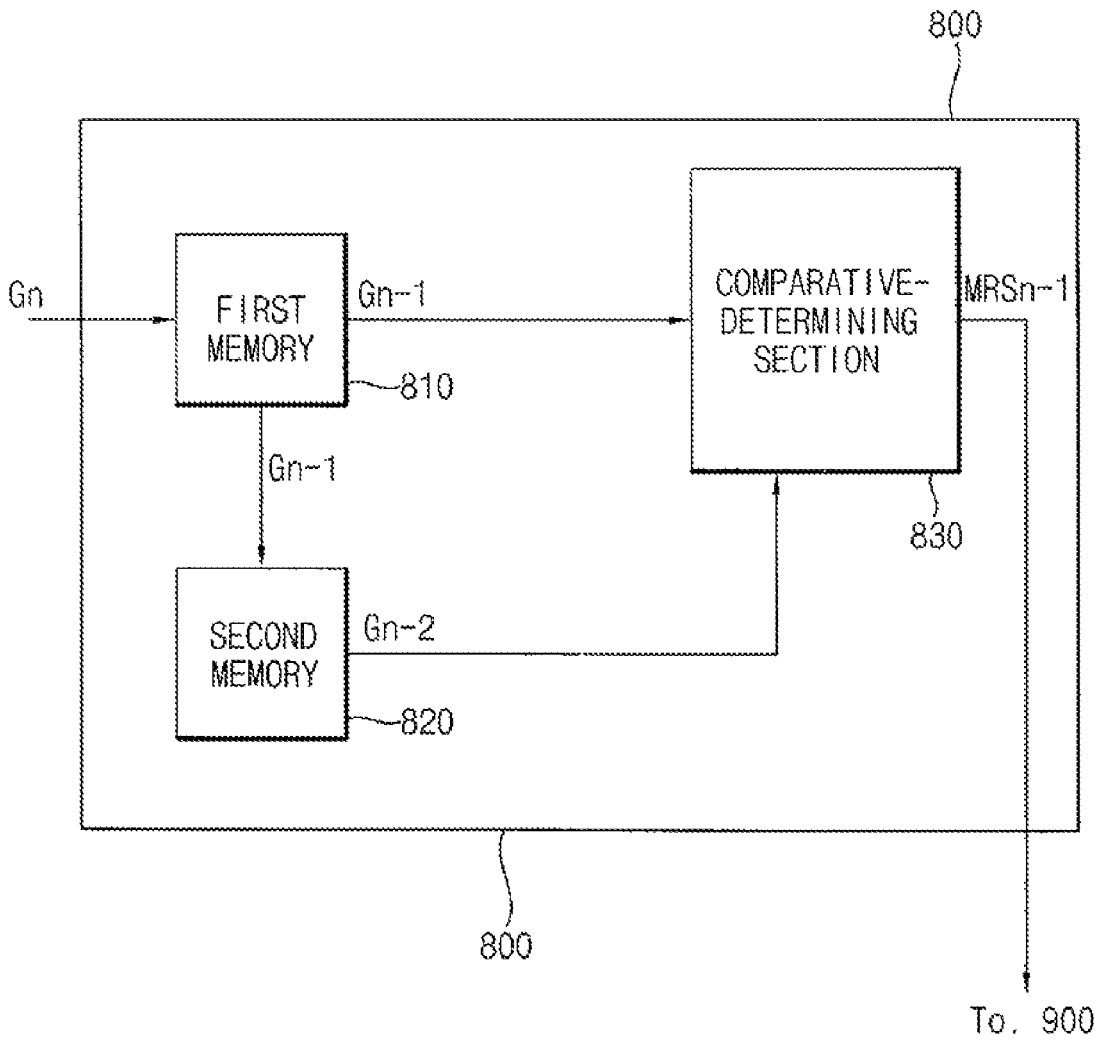
FIG. 10 is a block diagram illustrating the change rate calculating section in FIG. 9.

FIG. 10 is a block diagram illustrating the change rate calculating section 800 shown in FIG. 9.

Referring to FIG. 10, the change rate calculating section 800 includes a first memory 810, a second memory 820, and a comparative-determining section 830.

The first memory 810 stores an image signal corresponding to the n-th frame, and outputs an image signal that is stored corresponding to the (n−1)-th frame to the comparative-determining section 830.

The second memory 820 stores an image signal corresponding to the (n−1)-th frame, and outputs an image signal that is stored corresponding to the (n−2)-th frame to the comparative-determining section 830.

The comparative-determining section 830 compares image signals of the (n−1)-th frame that are provided from the first memory 810 with image signals of the (n−2)-th frame that are provided from the second memory 820, so that the comparative-determining section 830 provides the lamp driving section 900 with the change rate signal.

In an exemplary embodiment, the comparative-determining section 830 provides the lamp driving section 900 with the change rate signal based on a change rate of a histogram corresponding to the image signal of the (n−2)-th frame and the image signal of the (n−1)-th frame, respectively.

In an exemplary embodiment, the comparative-determining section 830 provides the lamp driving section 900 with the change rate signal based on an edge change rate of an object corresponding to the image signal of the (n−2)-th frame and the image signal of the (n−1)-th frame, respectively.

As described above, when the image change rate is relatively small, the lamp is driven by using a PWM dimming signal having a normal "on" interval, and an analog dimming signal having a normal level.

Alternatively, when the image change rate is relatively large, the lamp is driven by using a PWM dimming signal having a short "on" interval that is shorter than the normal "on" interval, and an analog dimming signal having a high level that is higher than the normal level.

Accordingly, a blinking effect may be given to the lamp driving apparatus only when necessary, in response to a change rate of the images, so that motion blur of a moving image may be removed. Additionally, the life of the lamp may be extended.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A liquid crystal display ("LCD") device comprising:

a panel section displaying an image using a liquid crystal layer;

a lamp section providing the panel section with light;

an image signal processing section providing the panel section with an image signal that is supplied from an external device; and a lamp driving section driving the lamp section based on a change rate of the image signal, wherein the lamp driving section comprises:

a dimming transforming section outputting an analog dimming signal and a pulse-width modulation ("PWM") dimming signal.

2. The LCD device of claim 1, wherein the lamp driving section decreases an emission duty cycle of a lamp of the lamp section, and increases a current that is supplied to the lamp section during a period when the change rate is relatively high.

3. The LCD device of claim 1, wherein the lamp driving section maintains an emission duty cycle of the lamp and a current that is supplied to the lamp section during a period when the change rate is relatively low.

4. The LCD device of claim 1, wherein the light driving section comprises:

a change rate calculating section calculating a change rate signal from the image signal; and a power supplying section providing the lamp with power based on a vertical synchronizing signal corresponding to the image signal and the analog and PWM dimming signals, wherein the dimming transforming section outputs the analog dimming and PWM dimming signals, in response to a dimming signal that is supplied from an external device and the change rate signal.

5. The LCD device of claim 4, wherein the change rate calculating section is an MPEG decoder.

6. The LCD device of claim 4, wherein the dimming transforming section comprises:

a storing section storing an analog dimming reference value;

a comparator comparing the change rate signal and the reference change rate signal that is supplied from an external device, to output a comparative-determining signal;

an adder adding the comparative-determining signal and the analog dimming reference value, to output the analog dimming signal;

a subtracter subtracting the comparative-determining signal from a dimming signal that is supplied from an external device, to output the subtracted dimming signal; and a PWM transforming section transforming the subtracted dimming signal into a PWM dimming signal, and outputting the PWM dimming signal.

7. The LCD device of claim 4, wherein the dimming transforming section provides the power supplying section with a PWM dimming signal having a normal "on" interval, and an analog dimming signal having a normal level, when the calculated changes rate is smaller than or equal to the reference change rate, and provides the power supplying section with a PWM dimming signal having a short "on" interval that is relatively shorter than the normal "on" interval, and an analog dimming signal having a high level that is relatively higher than the normal level, when the calculated change rate is greater than the reference change rate.

8. The LCD device of claim 1, wherein the image signal processing section comprises, a timing control section that receives a first signal and a first synchronizing signal, to output a second image signal, a second synchronizing signal and a third synchronizing signal;

a data driver outputting a data signal to the panel section, in response to the second image signal and the second synchronizing signal; and a gate driver outputting a gate signal to the panel section, in response to the third synchronizing signal, wherein the timing control section comprises a change rate calculating section calculating a change rate signal from the first image signal.

9. The LCD device of claim 8, wherein the lamp driving section comprises:

a power supplying section providing the lamp section with power based on a fourth synchronizing signal corresponding to the image signal and the analog and PWM dimming signals, wherein the dimming section outputs the analog dimming and PWM dimming signals, in response to a dimming signal that is supplied from an external device and the change rate signal.

10. The LCD device of claim 9, wherein the fourth synchronizing signal is a vertical synchronizing signal.

11. The LCD device of claim 9, wherein the dimming transforming section comprises:

a storing section storing an analog dimming reference value;

a comparator comparing the change rate signal with the reference change rate signal that is supplied from an external device, to output a comparative-determining signal;

an adder adding the comparative-determining signal and the analog dimming reference value, to output the analog dimming signal;

a subtracter subtracting the comparative-determining signal from a dimming signal that is supplied from an external device, to output the subtracted dimming signal; and a PWM transforming section transforming the subtracted dimming signal into a PWM dimming signal, and outputting the PWM dimming signal.

12. The LCD device of claim 8, wherein the change rate calculating section comprises:

a first memory configured to store an image signal corresponding to the n-th frame, and output an image signal that is stored corresponding to the (n−1)-th frame;

a second memory configured to store an image signal corresponding to the (n−1)-th frame, and output an image signal that is stored corresponding to the (n−2)-th frame; and a comparative-determining section that compares image signals of the (n−1)-th frame that are provided from the first memory with image signals of the (n−2)-th frame that are provided from the second memory to provide the lamp driving section with the change rate signal.

13. The LCD device of claim 12, wherein the comparative-determining section outputs the change rate signal based on a change rate of a histogram corresponding to the image signal of the (n−2)-th frame and the image signal of the (n−1)-th frame, respectively.

14. The LCD device of claim 12, wherein the comparative-determining section outputs the change rate signal based on an edge change rate of an object corresponding to the image signal of the (n−2)-th frame and the image signal of the (n−1)-th frame, respectively.

* * * * *